US009049953B2

(12) United States Patent
Cha

(10) Patent No.: US 9,049,953 B2
(45) Date of Patent: Jun. 9, 2015

(54) CORD EMBEDDED ROMAN SHADE CURTAIN AND CORD EMBEDDED ROMAN SHADE USING THE SAME

(71) Applicant: DAEKYEONG TRIPLE CO., LTD., Daegu (KR)

(72) Inventor: Sang-Gun Cha, Daegu (KR)

(73) Assignee: DAEKYEONG TRIPLE CO., LTD., Daegu (KR)

( * ) Notice: Subject to any disclaimer, the term of this patent is extended or adjusted under 35 U.S.C. 154(b) by 33 days.

(21) Appl. No.: 13/945,374

(22) Filed: Jul. 18, 2013

(65) Prior Publication Data

US 2014/0367054 A1 Dec. 18, 2014

(30) Foreign Application Priority Data

Jun. 17, 2013 (KR) ..... 10-2013-0069147

(51) Int. Cl.
*E06B 9/262* (2006.01)
*A47H 5/032* (2006.01)
*A47H 23/00* (2006.01)

(52) U.S. Cl.
CPC ..... *A47H 5/032* (2013.01); *A47H 23/00* (2013.01)

(58) Field of Classification Search
CPC ..... E06B 9/262
USPC ..... 160/84.01, 348, 176.1 R, 178.3, 177 R
See application file for complete search history.

(56) References Cited

U.S. PATENT DOCUMENTS

| | | | | |
|---|---|---|---|---|
| 4,765,388 | A * | 8/1988 | Dohlemann | 160/84.01 |
| 5,662,147 | A * | 9/1997 | Haiber | 139/384 R |
| 5,791,392 | A * | 8/1998 | Fernandez Lopez | 160/238 |
| 2012/0103538 | A1* | 5/2012 | Gleinser | 160/84.04 |
| 2013/0160953 | A1* | 6/2013 | Perkowitz | 160/84.01 |
| 2014/0060759 | A1* | 3/2014 | Gerster | 160/344 |

FOREIGN PATENT DOCUMENTS

KR 20-0444019 Y1 4/2009

* cited by examiner

*Primary Examiner* — Blair M Johnson

(57) ABSTRACT

Disclosed herein is a cord embedded roman shade curtain which is configured to include a curtain 10, a pocket curtain 20, a connection belt 30, and a cord 40. Further, the present invention relates to a cord embedded roman shade which is configured to include a curtain 10, a pocket curtain 20, a connection belt 30, a cord 40, a rotating bar 50, a frame 60, and a tow rope 70. Therefore, the curtain can be integrally woven without forming a separate ring and the cord is not exposed to the outside to prevent the accidents that the cord is wound around a child's hand or neck.

10 Claims, 7 Drawing Sheets

--Prior Art--

CORD EMBEDDED ROMAN SHADE CURTAIN AND CORD EMBEDDED ROMAN SHADE USING THE SAME

CROSS REFERENCE TO RELATED APPLICATION

This application claims the benefit of Korean Patent Application No. 10-2013-0069147, filed on Jun. 17, 2013, entitled "CORD EMBEDDED ROMAN SHADE CURTAIN AND CORD EMBEDDED ROMAN SHADE USING THE SAME", which is hereby incorporated by reference in its entirety into this application.

BACKGROUND OF THE INVENTION

1. Technical Field

The present invention relates to a cord embedded roman shade curtain and a cord embedded roman shade using the same, and more particularly, to a cord embedded roman shade curtain including a pocket curtain and a cord embedded roman shade using the same.

2. Description of the Related Art

A curtain has generally been used to block light or objects in daily life, such as blocking sunlight, covering the stage, or the like. Various kinds of curtains have been used in daily life. For example, there are a general curtain unfolded and folded left and right, a vertical blind consisting of a plurality of pieces of which the tilt angle may be adjustable, a roll screen curtain wound and unwound around a rotating roll, a roman shade folded by a winding operation of a length adjustable string, and the like.

In recent, as people consider functions and esthetic elements of a curtain important, a roman shade with a beautifully folded shape has become popular. Since the roman shade basically forms a plurality of layers as a curtain portion ascends while being folded, the roman shade has a beautiful appearance when it completely ascends.

The roman shade according to the related art is disclosed in Patent Document 1.

FIG. 1 is a perspective view illustrating a roman shade according to the related art and the roman shade according to the related art is configured to include a curtain 1, a ring 2 disposed on a back surface of the curtain 1, and a cord 3 passing through the ring 2 to be connected to a lower portion of the curtain 1.

However, the roman shade according to the related art has a problem in that the ring 2 is separately configured to connect the cord 3 to the curtain 1.

Further, the cord 3 is generally made of a transparent, thin, and hard material so as not to be seen well in the appearance even though the cord 3 is exposed to the outside. In this case, owing to the structure in which the cord 3 is exposed to the outside, the accidents that the cord 3 is wound around a child's hand or neck during playing may occur.

RELATED ART DOCUMENT

Patent Document (Patent Document 1) KR 20-0444019 Y1 (Apr. 2, 20009)

SUMMARY OF THE INVENTION

An object of the present invention is to provide a cord embedded roman shade curtain including a pocket curtain and preventing a cord from being exposed to the outside by including a cord therein, and a connection belt, and a cord embedded roman shade using the same.

According to an exemplary embodiment of the present invention, there is provided a cord embedded roman shade curtain, including: a curtain; a pocket curtain woven on a back surface of the curtain; a connection belt woven between the curtain and the pocket curtain along a horizontal direction and connecting the curtain with the pocket curtain; and a cord disposed in the pocket curtain and passing through the connection belt to be fixed to a lower portion of the curtain.

According to another exemplary embodiment of the present invention, there is provided a cord embedded roman shade, including: a curtain; a pocket curtain woven on a back surface of the curtain; a connection belt woven between the curtain and the pocket curtain along a horizontal direction and connecting the curtain with the pocket curtain; a cord disposed in the pocket curtain and passing through the connection belt to be fixed to a lower portion of the curtain; a rotating bar fixed with one end of the cord; a frame having a rotating shaft of both ends of the rotating bar connected to both ends thereof and fixed with the curtain and the pocket curtain; and a tow rope adjusting a rotation of the rotating bar.

DESCRIPTION OF THE EXEMPLARY EMBODIMENTS

Hereinafter, a cord embedded roman shade curtain and a cord embedded roman shade using the same according to the present invention will be described in more detail with reference to the accompanying drawings.

Figure 1:
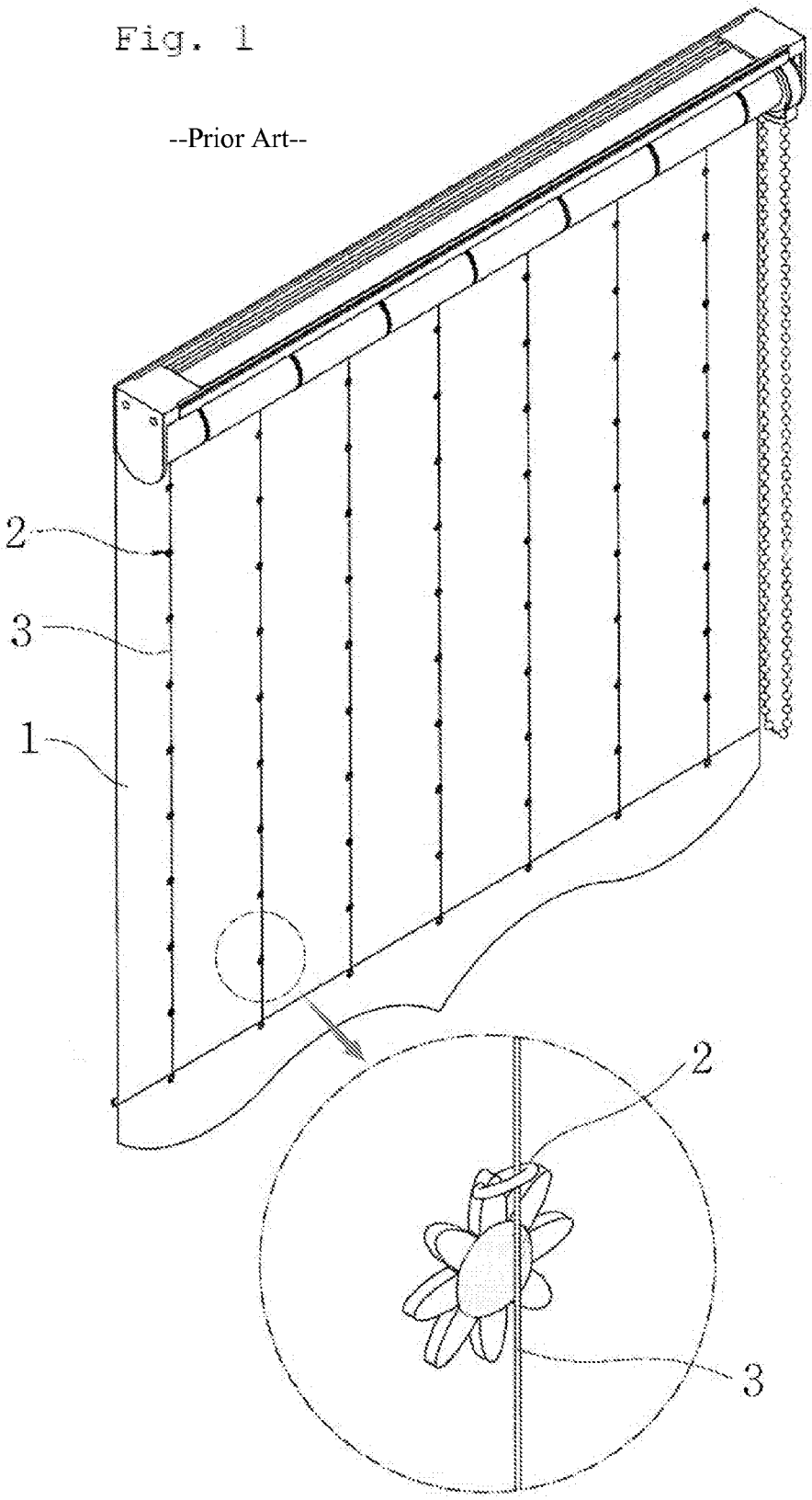
FIG. 1 is a perspective view illustrating a roman shade according to the related art.
Figure 2:
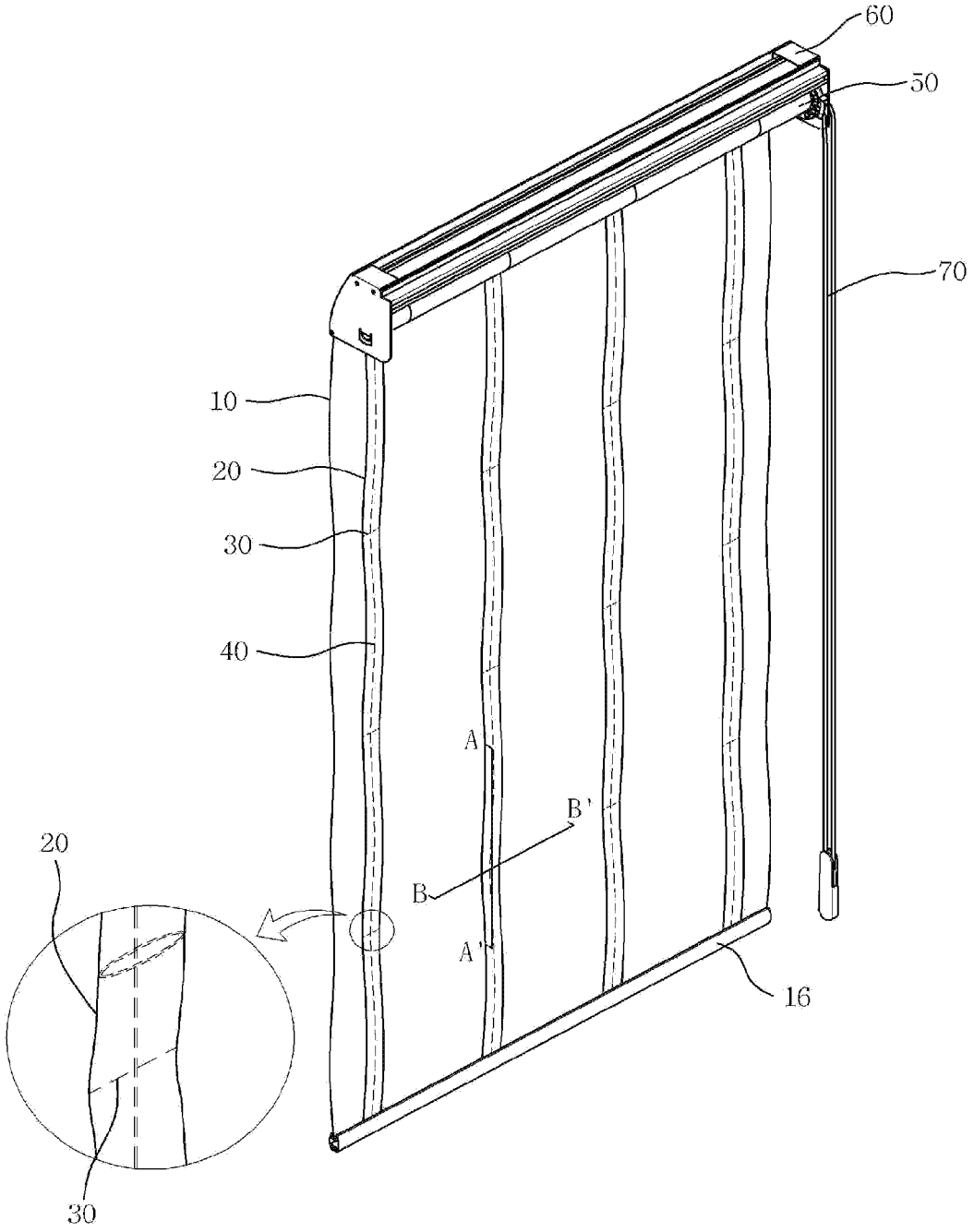
FIG. 2 is a perspective view illustrating a cord embedded roman shade according to an exemplary embodiment of the present invention.
Figure 3:
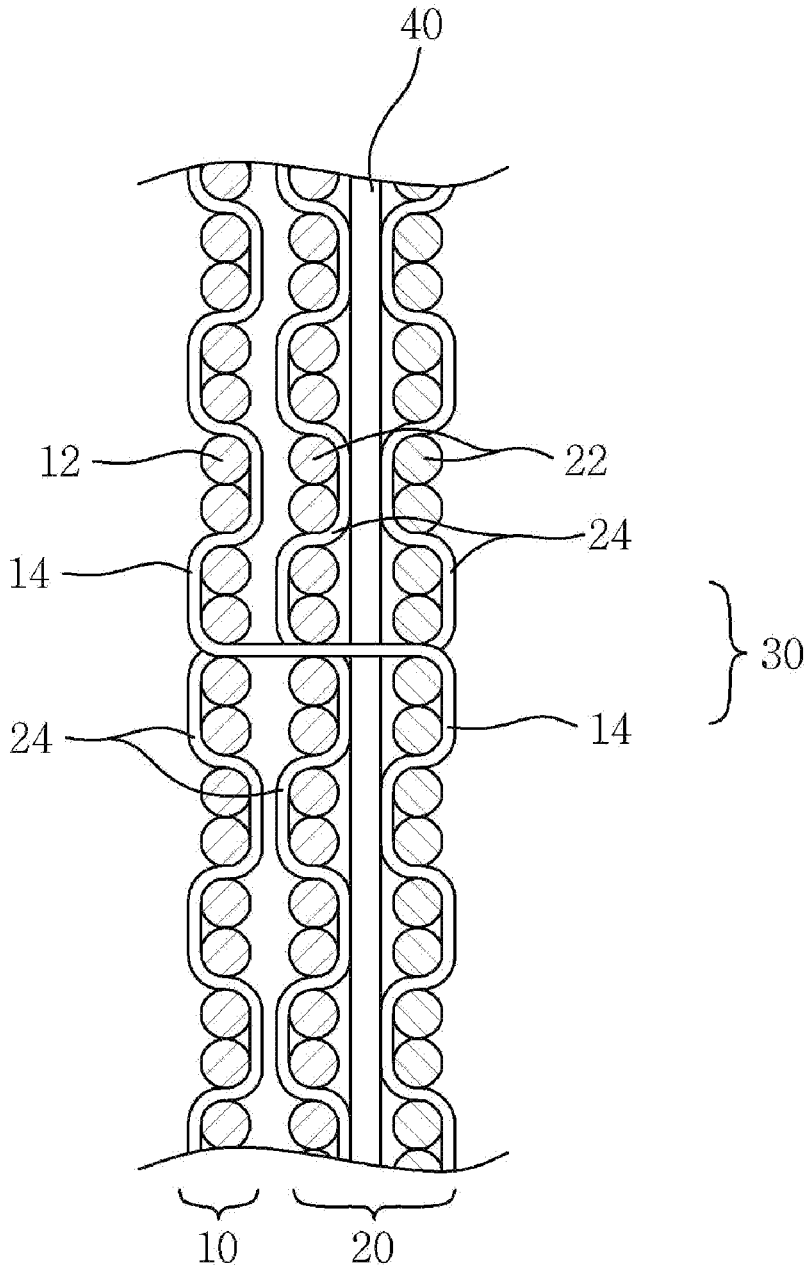
FIG. 3 is a cross-sectional view of A-A' of FIG. 2 illustrating a connection belt according to a first exemplary embodiment of the present invention.
Figure 4:
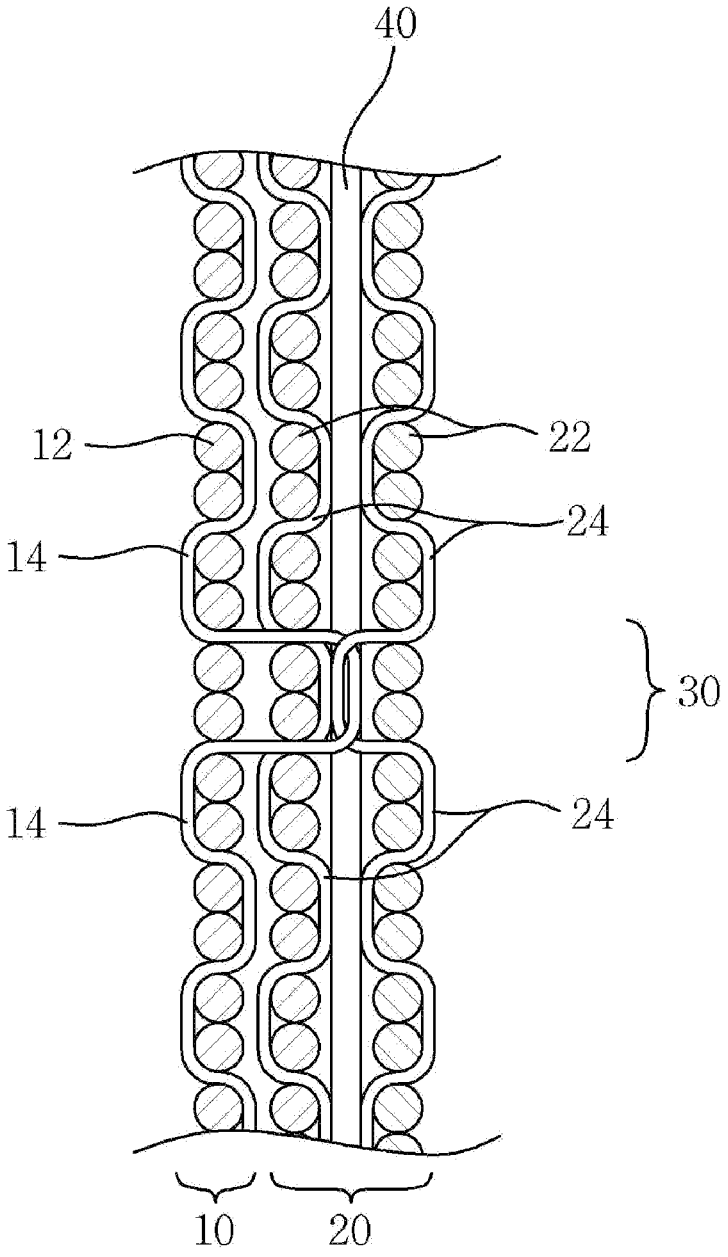
FIG. 4 is a cross-sectional view of A-A' of FIG. 2 illustrating a connection belt according to a second exemplary embodiment of the present invention.
Figure 5A:
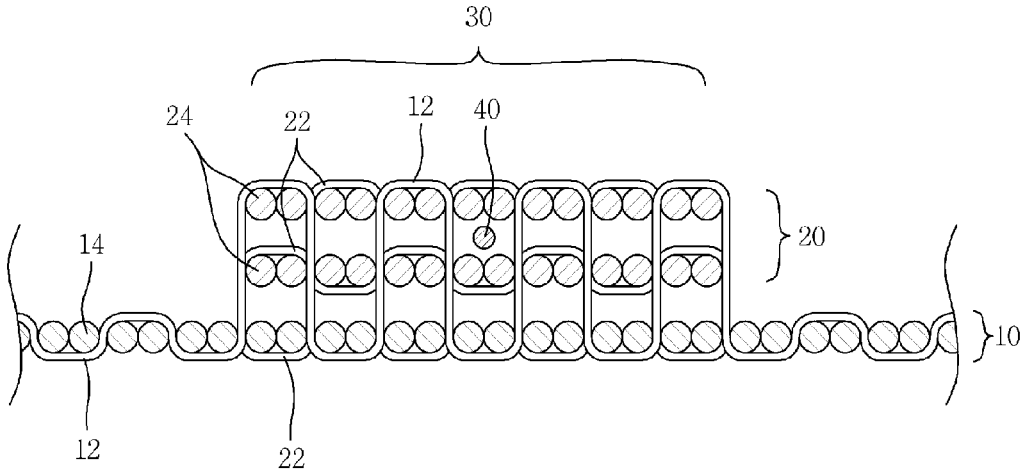
FIGS. 5A and 5B are two types of a cross-sectional view of B-B' of FIG. 2 illustrating a connection belt according to a third exemplary embodiment of the present invention.
Figure 5B:
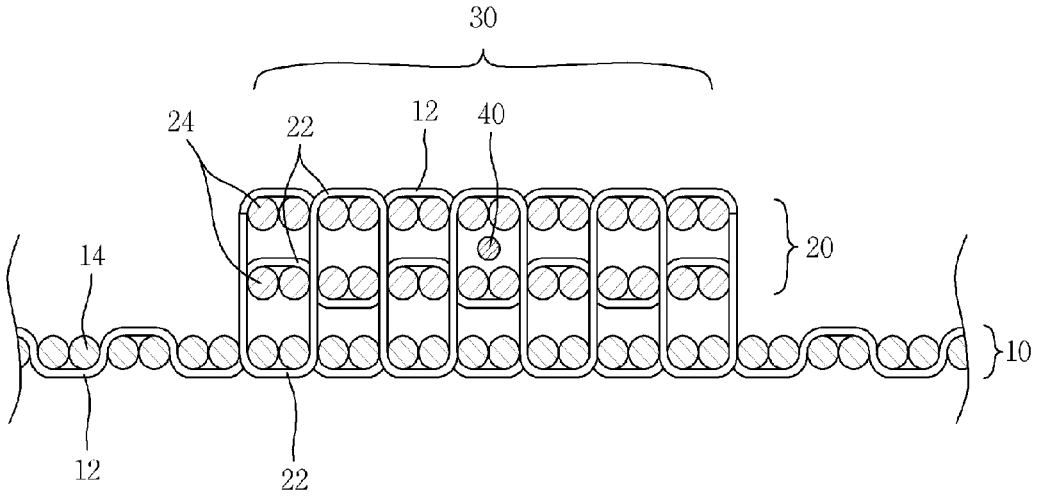

The present invention relates to a cord embedded roman shade curtain and a cord embedded roman shade curtain using the same and FIG. 2 is a perspective view illustrating a cord embedded roman shade according to an exemplary embodiment of the present invention, FIG. 3 is a cross-sectional view of A-A' of FIG. 2 illustrating a connection belt according to a first exemplary embodiment of the present invention, FIG. 4 is a cross-sectional view of A-A' of FIG. 2 illustrating a connection belt according to a second exemplary embodiment of the present invention, and FIGS. 5A and 5B are two types of a cross-sectional view of B-B' of FIG. 2 illustrating a connection belt according to a third exemplary embodiment of the present invention.

The cord embedded roman shade curtain according to the exemplary embodiment of the present invention is configured to include a curtain 10, a pocket curtain 20 woven on a back surface of the curtain 10, a connection belt 30 formed between the curtain 10 and the pocket curtain 20 along a horizontal direction and connecting the curtain 10 to the pocket curtain 20, and a cord 40 installed in the pocket curtain 20 and passing through the connection belt 30 to be fixed to a lower portion of the curtain 10.

The cord embedded roman shade according to the exemplary embodiment of the present invention is configured to include the curtain 10, the pocket curtain 20 woven on a back surface of the curtain 10, the connection belt 30 formed between the curtain 10 and the pocket curtain 20 along a horizontal direction and connecting the curtain 10 to the pocket curtain 20, the cord 40 installed in the pocket curtain 20 and passing through the connection belt 30 to be fixed to the lower portion of the curtain 10, a rotating bar 50 fixed to one end of the cord 40, a frame 60 having a rotating shaft of both ends of the rotating bar 50 connected to both ends thereof and fixed to the curtain 10 and the pocket curtain 20, and a tow rope 70 adjusting a rotation of the rotating bar 50.

Each component will be described below.

The curtain 10 is formed by intersecting a first weft 12 with a first warp 14. A tension holding bar 16 is connected to the lower portion of the curtain 10 and as illustrated in FIG. 2, the tension holding bar 16 has a predetermined weight and is disposed to the lower portion of the curtain 10 to apply gravity to the curtains so as to allow the curtains to sway less from external impact, such that the curtain can be stably being mounted.

The pocket curtain 20 is disposed on the back surface of the curtain 10 and is woven by intersecting a second weft 22 with a second warp 24. As illustrated in FIG. 2, the pocket curtain 20 has a double form and has a path provided therein and a cord 40 to be described below provided therein. Therefore, since the cord 40 is not exposed to the outside, the accidents that the cord 40 is wound around a child may be previously prevented.

Meanwhile, the pocket curtain 20 is integrally woven at the time of weaving the curtain 10 and when the pocket curtain is integrally woven, the second weft 22 is connected between the pocket curtains 20. If necessary, the second weft is subjected to shearing to be removed, such that the curtain is clean in appearance and winding the second weft 22 around children during playing is prevented.

The connection belt 30 is formed between the curtain 10 and the pocket curtain 20 along a horizontal direction to serve to connect the curtain 10 with the pocket curtain 20. Further, the connection belt 30 is not formed using a separate yarn, but is formed by intersecting the first and second wefts 12 and 22 with the first and second warps 14 and 24 and has the cord 40 to be described below passing therethrough. Therefore, the cord embedded roman shade according to the exemplary embodiment of the present invention is integrally woven without forming a separate ring, such that the weaving time may be reduced, the firmness may be increased, and the finishing may be clear. Further, additional operations need not perform, and therefore costs may be saved.

Meanwhile, the connection belt 30 connects the curtain 10 with the pocket curtain 20 using a separate yarn if necessary, thereby simplifying the weaving process.

The curtain 10 and the pocket curtain 20 according to the exemplary embodiment of the present invention will be described below with reference to FIGS. 3 to 5.

According to the exemplary embodiment of the present invention, as illustrated in FIG. 3, the first warp 14 descends while intersecting the first weft 12 and then intersects the second weft 22. In this case, since the pocket curtain 20 is a back surface, the second weft 22 is formed double and as illustrated in FIG. 3, the first warp 14 may intersect the second weft 22 at an outermost side and if necessary, may also intersect the second weft 22 at a center.

As described above, the second warp 24 descends while intersecting the second weft 22 and then intersects the first weft 12 at a position at which the first warp 14 intersects the second weft 22. In this case, as illustrated in FIG. 3, the second warp 24 intersecting the first weft 12 is the second warp 24 or if necessary, may be the second warp 24 at a center. Therefore, the curtain 10 and the pocket curtain 20 are connected to each other by intersecting the warp and the portion at which the first warp 14 and the second warp 24 intersect each other is the connection belt 30.

According to the first exemplary embodiment of the present invention, even though the thickness of the first warp 14 and the second warp 24 or the thickness of the first weft 12 and the second weft 22 is used differently, the curtain may be woven without being bent in one direction. That is, when the curtain is woven with each yarn in the state in which a thickness of a yarn used for the curtain 10 and a thickness of a yarn used for the pocket curtain 20 are different, the size of the curtain 10 and the size of the pocket curtain 20 is different from each other and therefore the first exemplary embodiment of the present invention solves the above-mentioned problem by intersecting the yarn.

According to a second exemplary embodiment of the present invention, as illustrated in FIG. 4, the first warp 14 descends while intersecting the first weft 12 and the second warp 24 descends while intersecting the second weft 22 and then the first warp 14 and the second warp 24 are twisted at a predetermined position. Then, the first warp 14 intersects the first weft 12 and the second warp 24 intersects the second weft 22. In this case, as illustrated in FIG. 4, the second warp 24 intersecting the first warp 14 is the second warp 24 at the outermost side or if necessary, may be the second weft 24 at an inner side. Therefore, the curtain 10 and the pocket curtain 20 are connected to each other by the twisting of a warp and a portion at which the first warp 14 and the second warp 24 are twisted is the connection belt 30.

According to a third exemplary embodiment of the present invention, as illustrated in FIGS. 5A and 5B, the first weft 12 alternately intersects the first warp 14 and the second warp 24 and the second weft 22 alternately intersects the second warp 24 and the first warp 14. That is, the first weft 12 and the second weft 22 each alternately intersect the first and second warps 14 and 24 while intersecting each other and the portion at which the first weft 12 and the second weft 22 intersect each other is the connection belt 30. In this case, as illustrated in FIGS. 5A and 5B, the first weft 12 may intersect the second warp 24 at the outermost side and if necessary, may intersect the second warp 24. Further, the intersecting structure of the first weft 12 and the intersecting structure o the second weft 22 are each illustrated in FIGS. 5A and 5B. According to the third exemplary embodiment of the present invention, the connection belt 30 is formed by intersecting the weft and therefore the thickness of the connection belt 30 may be adjusted by increasing the number of intersecting wefts. Therefore, the curtain 10 and the pocket curtain 20 may be more firmly connected to each other and a crease interval of the cord embedded roman shade according to the exemplary embodiment of the present invention may be variously adjusted.

As described above, the connection belt 30 may be formed by various methods and if necessary, is formed in plural along a vertical direction, such that the crease of the cord embedded roman shade according to the exemplary embodiment of the present invention may be formed in plural.

The cord 40 is disposed in the pocket curtain 20 and one end thereof is fixed to the rotating bar 50 to be described below and the other end thereof is fixed to the lower portion of the curtain 10 passing through the connection belt 30. Therefore, the cord 40 is wound or unwound by rotating the rotating bar 50 and thus the curtain 10 and the pocket curtain 20 may be folded or unfolded.

Meanwhile, since the cord 40 is disposed in the pocket curtain 20 so as not to be exposed to the outside, the accidents that the cord is wound around a child's body during playing or the operation of the roman shade, and the like, may be prevented.

The curtain 10, the pocket curtain 20, and the cord 40 are integrally woven at the time of weaving and if necessary, the curtain 10 and the pocket curtain 20 are first woven and then the cord 40 may be separately inserted into the pocket curtain 20.

The rotating bar 50 is an element rotating to operate the cord embedded roman shade according to the exemplary embodiment of the present invention and the rotating shaft is connected with the frame 60 to be described below. Further, the rotating bar 50 is connected with one end of the cord 40 and thus the cord 40 is wound or unwound by rotating the rotating bar 50.

As illustrated in FIG. 2, both ends of the frame 60 are connected with the rotating shaft of both ends of the rotating bar 50 and thus the rotating bar 50 may rotate to the frame 60. The frame 60 is attached at a position at which the cord embedded roman shade according to the exemplary embodiment of the present invention is disposed.

The tow rope 70 is wound around one end of the rotating bar 50 to serve to adjust the rotation of the rotating bar 50.

Figure 6:
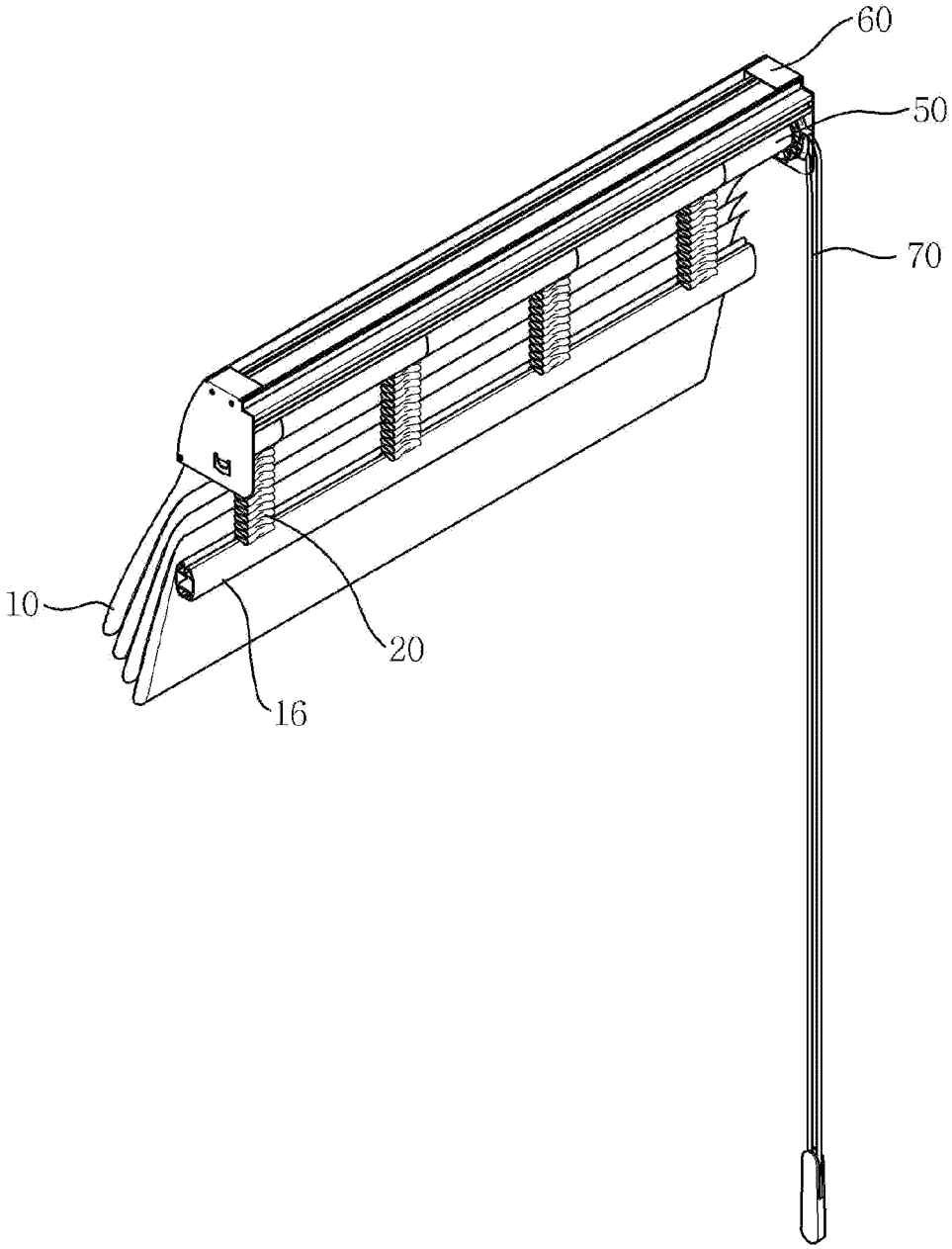
FIG. 6 is a perspective view illustrating an operational state of a cord embedded roman shade according to an exemplary embodiment of the present invention.

Hereinafter, the operational state of the cord embedded roman shade according to the present invention will be described in more detail with reference to the accompanying drawings. FIG. 6 is a perspective view illustrating the operational state of the cord embedded roman shade according to the exemplary embodiment of the present invention.

When the rotating bar 50 rotates by the tow rope 70, the curtain 10 and the pocket curtain 20 start to ascend from below while the cord 40 is wound around the rotating bar 50. In this case, since the cord 40 is disposed in the pocket curtain 20, both surfaces of the pocket curtain 20 different from the curtain 10 having a large crease are provided with a relatively small crease. Further, the first crease of the curtain 10 is completely formed while the lower portion of the curtain 10 and the pocket curtain 20 is folded with the connection belt 30. When the cord 40 is completely wound around the rotating bar 50, the curtain 10 is provided with creases as many as the number of connection belts 30 as illustrated in FIG. 6.

Figure 7:
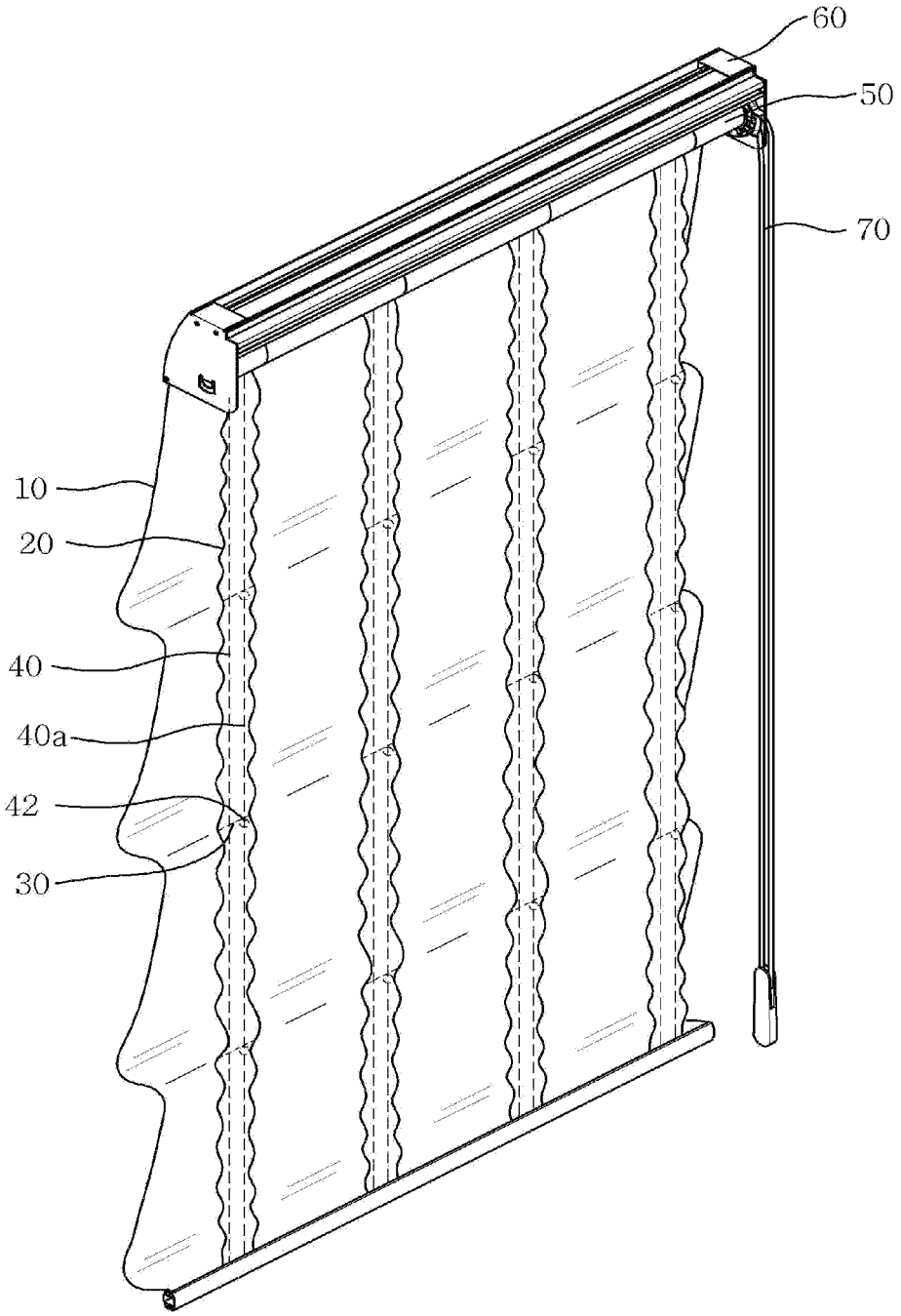
FIG. 7 is a perspective view illustrating a fixed bead according to an exemplary embodiment of the present invention.

FIG. 7 is a perspective view illustrating a fixed bead according to an exemplary embodiment of the present invention.

The fixed bead 42 is a bead formed with a through hole and as illustrated in FIG. 7, is fixed on auxiliary cords 40*a* fixed to the lower and upper portions of the curtain 10, such that when the curtains are unfolded, the fixed bead 42 is hung on the connection belt 30, the curtains are no more unfolded and the creases are formed. Similarly, the auxiliary cord 40*a* is disposed in the pocket curtain 20 so as not to be exposed to the outside.

According to the cord embedded roman shade curtain and the cord embedded roman shade using the same according to the exemplary embodiments of the present invention, the curtain can be integrally woven without forming the separate ring and the cord is not exposed to the outside which prevents accidents such as the cord 5 being wound around a child's hand or neck.

What is claimed is:

1. A cord embedded roman shade curtain, comprising:

a curtain including a first weft woven with a first warp;

a pocket curtain woven on a back surface of the curtain, the pocket curtain including a second weft woven with a second warp;

a connection belt between the curtain and the pocket curtain along a horizontal direction and connecting the curtain with the pocket curtain; and a cord disposed in the pocket curtain and passing through the connection belt to be fixed to a lower portion of the curtain, wherein the first warp is partially twisted with the second warp to form the connection belt.

2. The cord embedded roman shade curtain of claim 1, further comprising a second connection belt.

3. The cord embedded roman shade curtain of claim 1, further comprising a second pocket curtain and a second cord.

4. A cord embedded roman shade, comprising:

a curtain including a first weft woven with a first warp;

a pocket curtain woven on a back surface of the curtain, the pocket curtain including a second weft woven with a second warp;

a connection belt between the curtain and the pocket curtain along a horizontal direction and connecting the curtain with the pocket curtain;

a cord disposed in the pocket curtain and passing through the connection belt to be fixed to a lower portion of the curtain;

a rotating bar fixed with one end of the cord;

a frame having a rotating shaft of both ends of the rotating bar connected to both ends thereof and fixed with the curtain and the pocket curtain; and a tow rope adjusting a rotation of the rotating bar, wherein the first warp is partially twisted with the second warp to form the connection belt.

5. The cord embedded roman shade of claim 4, further comprising a second connection belt.

6. The cord embedded roman shade of claim 4, further comprising a second pocket curtain and a second cord.

7. The cord embedded roman shade of claim 4, further comprising:

an auxiliary cord disposed in the pocket curtain and having one end fixed to an upper portion of the curtain and the other end passing through the connection belt and fixed to the lower portion of the curtain, wherein the auxiliary cord is further provided with a fixed bead.

8. The cord embedded roman shade of claim 4, further comprising a second connection belt.

9. The cord embedded roman shade of claim 4, further comprising a second pocket curtain and a second cord.

10. A cord embedded roman shade, comprising:

a curtain;

a pocket curtain woven on a back surface of the curtain;

a connection belt between the curtain and the pocket curtain along a horizontal direction and connecting the curtain with the pocket curtain;

a cord disposed in the pocket curtain and passing through the connection belt to be fixed to a lower portion of the curtain;

a rotating bar fixed with one end of the cord;

a frame having a rotating shaft of both ends of the rotating bar connected to both ends thereof and fixed with the curtain and the pocket curtain;

an auxiliary cord disposed in the pocket curtain and having one end fixed to an upper portion of the curtain and the other end passing through the connection belt and fixed to the lower portion of the curtain;

wherein the auxiliary cord is further provided with a fixed bead; and a tow rope adjusting a rotation of the rotating bar.

* * * * *